US010172751B1

(12) United States Patent
Balmer

(10) Patent No.: US 10,172,751 B1
(45) Date of Patent: Jan. 8, 2019

(54) COLLAPSIBLE TRANSPORT CHAIR WITH BAGGAGE CAPABILITY

(71) Applicant: David Michael Balmer, Surprise, AZ (US)

(72) Inventor: David Michael Balmer, Surprise, AZ (US)

( * ) Notice: Subject to any disclaimer, the term of this patent is extended or adjusted under 35 U.S.C. 154(b) by 337 days.

(21) Appl. No.: 15/222,928

(22) Filed: Jul. 28, 2016

(51) Int. Cl.
*A61G 5/08* (2006.01)
*A61G 5/10* (2006.01)

(52) U.S. Cl.
CPC ..... *A61G 5/08* (2013.01); *A61G 5/10* (2013.01); *A61G 5/0866* (2016.11)

(58) Field of Classification Search
CPC ... A61G 5/00; A61G 5/08; A61G 5/10; A61G 5/0833; A61G 5/0841; A61G 5/1037; A61G 5/085; A61G 5/0858
USPC ..... 280/650
See application file for complete search history.

(56) References Cited

U.S. PATENT DOCUMENTS 1,805,136 A * 5/1931 Eberle ..... B62B 7/10 280/650
2,362,186 A * 11/1944 Brantz ..... B62B 7/10 280/47.4
2,450,373 A * 9/1948 Fiene ..... B62B 7/02 280/649
2,545,336 A * 3/1951 Binder ..... B62B 7/10 220/9.2
3,550,998 A * 12/1970 Korol ..... A47D 1/06 280/31
4,239,259 A * 12/1980 Martinez ..... A47D 1/004 280/649
4,623,163 A * 11/1986 Potts ..... A61G 5/08 16/35 R
4,902,029 A * 2/1990 Gain ..... A61G 5/027 280/250.1
5,125,674 A * 6/1992 Manuszak ..... B62B 7/12 280/30
6,357,784 B1 * 3/2002 Mitzman ..... B62B 7/02 280/30
6,581,945 B1 * 6/2003 Shapiro ..... B62B 1/206 280/30
6,918,608 B2 * 7/2005 Crisp ..... B62B 7/068 280/47.38
7,229,083 B2 * 6/2007 Arai ..... B62B 7/123 280/47.38
8,814,182 B1 * 8/2014 Kirby ..... A61H 3/04 135/66
2002/0070533 A1 * 6/2002 Owens ..... A61H 3/04 280/650

(Continued)

*Primary Examiner* — Ruth Ilan

(57) ABSTRACT

This Apparatus consists of a collapsible Transport Chair providing the ability to transport a passenger and significant baggage as well as bi-directional operation over rougher surfaces. The Transport Chair includes a strong platform containing a footrest, wheel and braking assemblies. The platform supports a hinged front frame enclosing a passenger seat frame and seat; plus a hinged rear support frame to secure the front frame and seat when assembled. Handgrips and brake levers are provided for the caregiver to push from the rear as well as a fold-down handle bar to allow the transport chair to be propelled from the front. The rear support frame and the front frame along with the folding seat collapse onto the platform for storage and/or transport.

8 Claims, 9 Drawing Sheets

(56) References Cited

U.S. PATENT DOCUMENTS

| | | | | |
|---|---|---|---|---|
| 2003/0090073 | A1* | 5/2003 | Whang | A61G 5/00 280/33.991 |
| 2008/0129016 | A1* | 6/2008 | Willis | A61G 5/08 280/639 |
| 2008/0238041 | A1* | 10/2008 | Chen | A61G 5/08 280/650 |
| 2009/0236826 | A1* | 9/2009 | Queen | B62B 7/10 280/650 |
| 2011/0304110 | A1* | 12/2011 | Long | A61G 5/00 280/33.992 |
| 2014/0312599 | A1* | 10/2014 | Millman-Wood | B62B 7/145 280/650 |

* cited by examiner

COLLAPSIBLE TRANSPORT CHAIR WITH BAGGAGE CAPABILITY

FIELD OF THE INVENTION

The present invention pertains generally to mobility apparatus' including "transport chairs", "wheel chairs" and "walkers".

BACKGROUND

Devices used primarily to provide transportation to mobility impaired people have been available for many years. The mobility devices include wheelchairs, transport chairs and walkers. Wheelchairs are generally self-propelled, motorized or pushed by a second person. Walkers are propelled by the user. Many of these devices are collapsible for transport or storage and some walkers are convertible into transport chairs (also called "transport wheelchairs"). A transport chair is a chair designed for its occupant to be propelled by another person. Transport chairs do not have the large wheel characteristic of a wheelchair but rely upon a set of four smaller wheels. The front two wheels of transport and wheelchairs are commonly of the "caster" type.

The difficulty with existing mobility devices is that they provide only limited convenience to a mobility impaired traveler who requires baggage transportability plus the ability to collapse for easy hand transport. A graphic example of the deficiency of existing devices can be witnessed watching a couple traveling through an airport with the caregiver pushing an airport-supplied wheelchair while trying to hold onto their luggage with the passenger pushing a wheeled walker with more baggage stacked on the walker seat. This Apparatus was designed under the premise that a mobility-impaired person and her/his caregiver should be able to travel most anywhere including an airport, train station, hotel or town square. In order to do this the apparatus needs to be able to carry a substantial amount of baggage, be constructed of suitable materials and collapse quickly for storage or transportation in an aircraft, train or automobile trunk. In addition, it should be able to travel over uneven pavement or gravel in a parking lot.

Examples of prior art include a foldable wheelchair (U.S. Pat. No. 5,560,636 A), a collapsible transport chair (U.S. Ser. No. 11/728,782), a convertible walker (U.S. Ser. No. 13/815,255), a commercial luggage capable non-collapsable transport chair (US20030090073 A1) and a wheelchair with luggage transporter (U.S. Pat. No. 4,902,029 A)

SUMMARY OF THE INVENTION

This Apparatus was specifically designed to have the ability to transport both a passenger and baggage plus a cane and/or lightweight walker, stored on the rear frame and platform under him/her, through a crowded airport, parking lot or gravel path in a park.

It also is capable of bi-directional operation. The Apparatus may be pushed from the rear in a manner like a conventional "transport wheelchair" or it may be pushed from the front using a fold-down front handle bar. Pushing from the front allows the larger rear wheels to roll over bumps and irregular surfaces like gravel and also provides increased security for the passenger and improved vocal communication between the passenger and the person propelling the Apparatus.

For operation involving the caregiver pushing from the rear of the chair using the side hand grips located and angled for comfortable grasp and control as well as easy access to brake levers. Also, a bar between the hand grips permits the caregiver to pull the transport chair backward in order to roll over small obstacles such as found in building and elevator entranceways.

In addition, the Apparatus is easily collapsible. The seat, arm supports, front and rear support frames collapse onto the platform for easy storage and transport in a vehicle such as an automobile, commercial aircraft or train.

BRIEF DESCRIPTION OF THE DRAWINGS

The following Nine (9) Figures are part of the Apparatus.

PREFERRED EMBODIMENT

Figure 3:
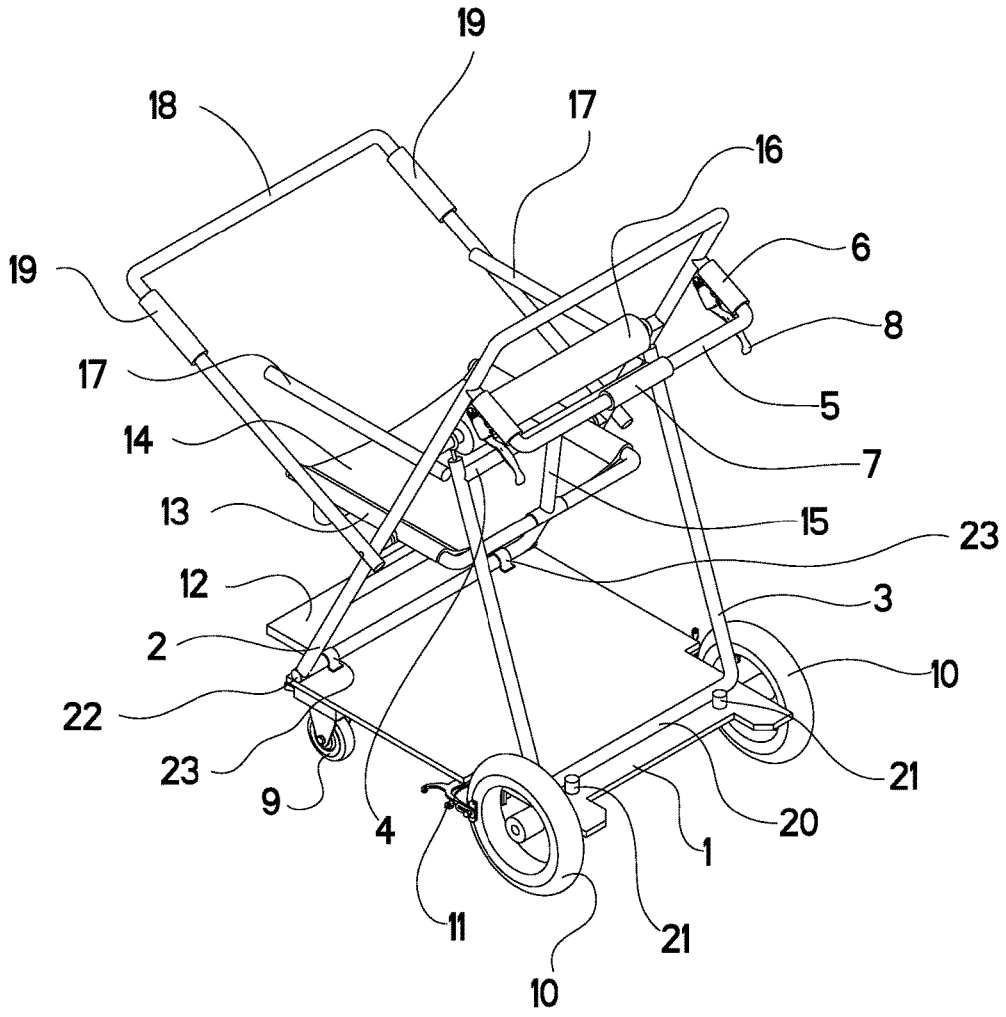
FIG. 3—Diagram of key parts—rear perspective—Featuring Platform 1, Front Frame 2, and Rear Support Frame 3.
Figure 4:
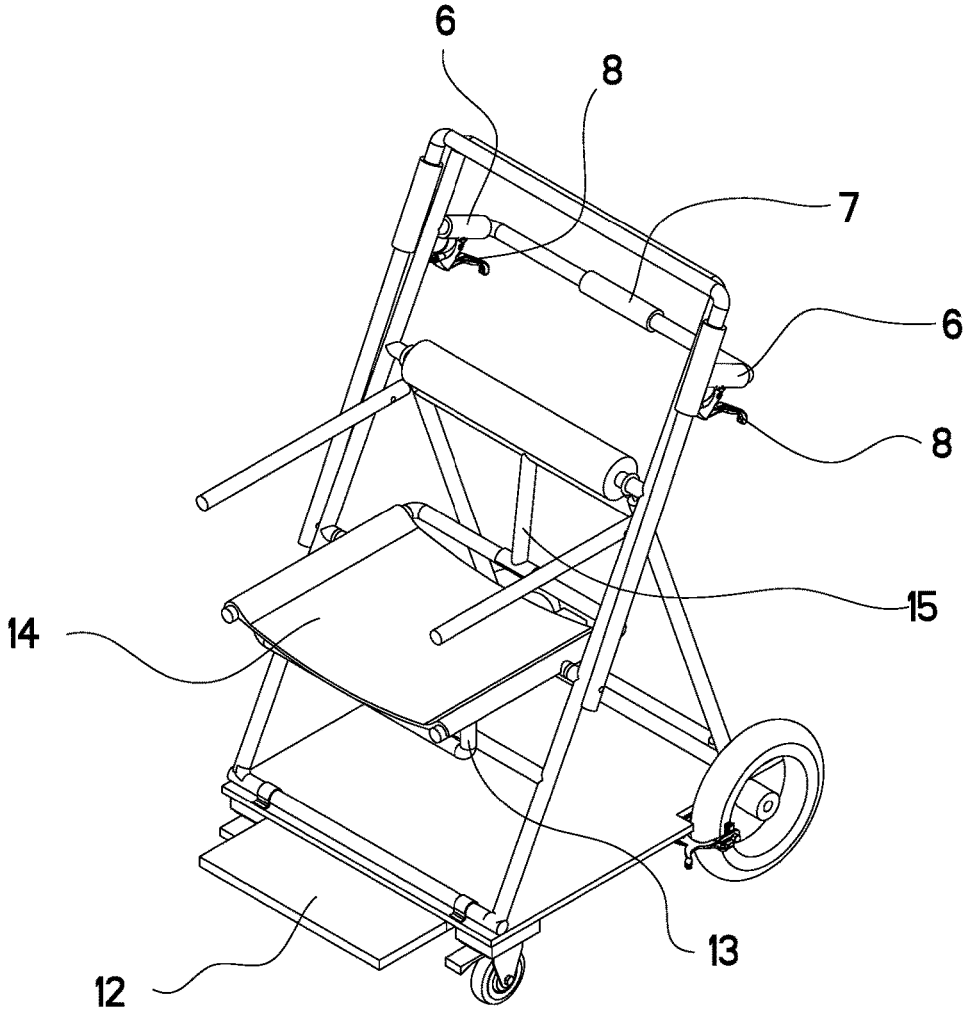
FIG. 4—Diagram of key parts—front perspective—Showing Stop Brace for Seat 15, Seat 14, Seat Frame 13, Foot Rest 12, Center Hand Grip 7, Side Hand Grips 6, and Brake Levers 8.

FIGS. 3 and 4 are "breakout" views of the Apparatus showing the numbering of the parts. The frame for the Apparatus is constructed of lightweight materials such as steel or aluminum tubing, plastic or composite material tubing (such as carbon fiber). The design of the Apparatus consists of three main components: a Front Frame 2, which holds a Seat 14, a Rear Support Frame 3, which provides strength and stability for the Front Frame 2, and a mobile Platform 1, which carries the passenger weight load and the front and rear support frames, plus has the ability to support additional baggage for transportation. Both the Front Frame 2 and the Rear Support Frame 3 connect to the Platform 1 in a hinge arrangement. When assembled for use, the three main components form a "triangle pattern" giving it the ability to support weight when the Seat 14 is in use.

Platform

Figure 2:
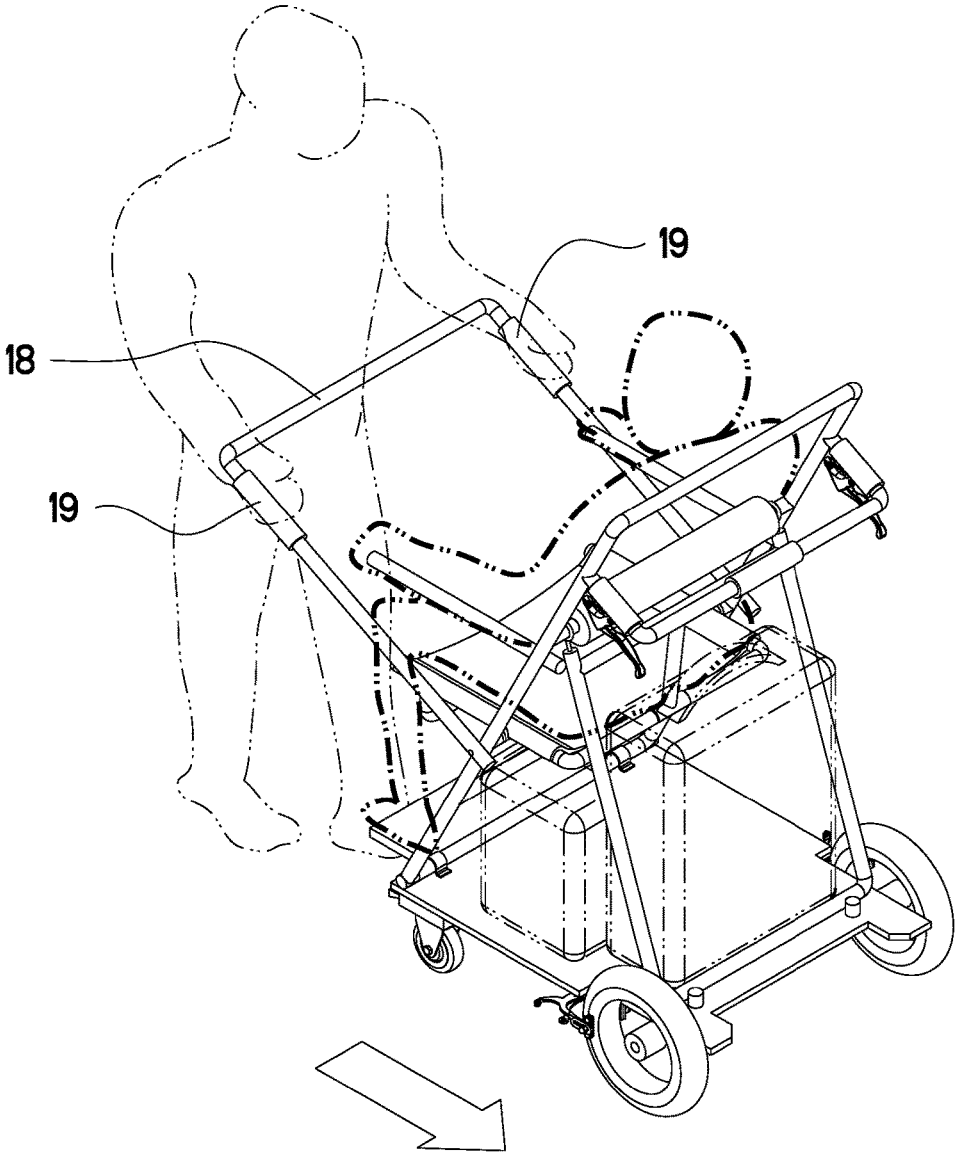
FIG. 2—Front Operation—Bi-directional feature showing the Apparatus, with seated passenger, and baggage stored on platform, and Front Handle Bar 18.
Figure 8:
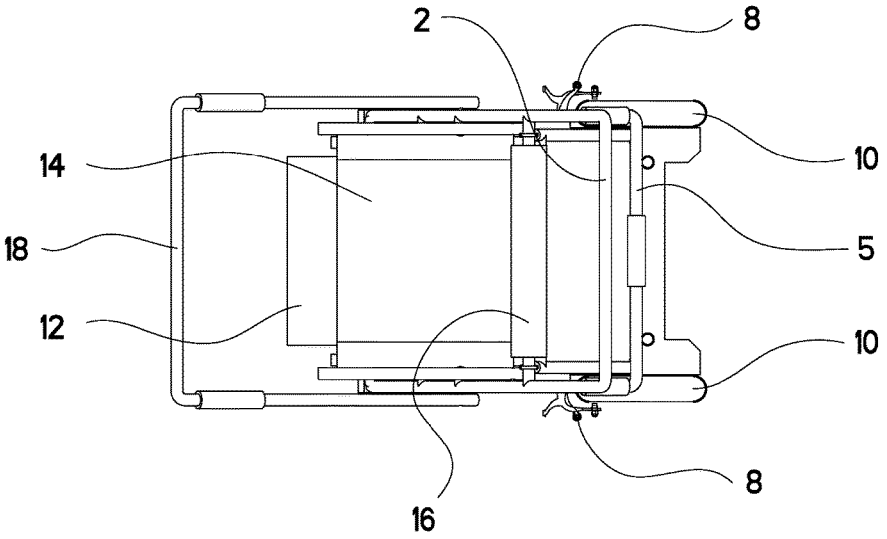
FIG. 8—Diagram—top view—Showing the Front Handle Bar 18 in the extended position, the Foot Rest 12 in the extended position, the Seat 14 in the extended position, the padded Backrest 16, the Rear Handle Bar 5, and the Large Wheels 10 with Brake Levers 8.

The Platform 1, with the attached Foot Rest 12, is shown as a solid piece, but may be constructed of molded plastic, wood, composite (such as carbon fiber), or a framework of several pieces of cut and shaped tubing (plastic, composite or metal) conjoined by brazing, welding, gluing or other means which fulfills it purpose to support the Front Frame 2 and the Rear Support Frame 3, attach to Wheels 9 and 10, and have the ability to carry baggage and the weight of a passenger. The Platform also has two Bottom Stops 21 as shown in FIGS. 2,3 and 8. These stops hold the Rear Support Frame in the upright position when assembled and allow the frame to be collapsed for storage and transport. The two Pivot Bolts 22, as shown in FIG. 3, attach the Front Frame 2 to the Platform 1 in such a manner as to secure the Front Frame to the Platform, but also to allow the Front Frame to be collapsed by folding.

Both the Caster Wheels 9 and fixed Large Wheels 10 are attached to the Platform 1. The Large Wheels 10, are constructed of a soft plastic or rubber tire and are designed to provide a softer and safer ride for the passenger as well as any baggage. The Large Wheels 10 are ball-bearing mounted and attached with fixed bolts. These wheels permit smooth rolling over bumps in the pavement, and avoid the wheels becoming lodged in cracks or coming to a complete stop due to small obstructions, such as pebbles, which may be the case with small wheels. The wheel rim may be constructed of metal or plastic. The wheels are shown with a transparent material rather than conventional spokes, however they may be constructed with any design and material which connects the wheel hub to the rim and provides the strength to support necessary weight. The smaller Wheels 9 are of the lockable caster-type, and can pivot to provide easy change of direction. They may be constructed of metal with plastic or rubber tires on a ball-bearing mount or they may be constructed with a softer tire such as is found on the Large Wheels 10 as long as the normal functions of a caster are met.

Mechanical Wheel Brakes 11, as shown in FIG. 3, are attached to the Large Wheels 10. They are controlled by Brake Levers 8 on the Front Frame's Rear Handle Bar 5. Cables connecting the brakes may be either mechanical or electrically operated. In addition, Brake Levers 8 may be locked either mechanically or held in the locked position by an elastic or VELCRO® (hook and loop) type strap to secure the Platform 1 from excessive movement particularly when a passenger is entering or leaving the Apparatus.

Front Frame and Seat

The Front Frame 2 is designed to hold a folding Seat 14, which may be used to transport a person or baggage such as a small suitcase or a box. The two Bottom Brackets 23 shown in FIG. 3, on the Front Frame 2, connect the Front Frame 2 to the Platform 1, in such a manner that the frame may move and be folded onto the Platform 1 for transport or storage, as illustrated in FIG. 8. The main components of the Front Frame 2 as illustrated in FIGS. 3 and 4 are: Front Handle Bar 18, Seat Frame 13, Seat 14, Stop Brace for Seat 15, Backrest 16, Arm Support 17, Rear Handle Bar 5 and Brake Lever 8.

The Seat 14 shown in FIGS. 3, 4 and 8, and Seat Frame 13 shown in FIGS. 3, 4, 6 and 9, are integral parts of the Front Frame 2. The Seat 14 itself is made of a breathable material such as canvas or nylon mesh. It can also be fabricated out of material such as molded plastic, with perforations to allow for air passage to increase the level of comfort for a passenger.

Figure 9:
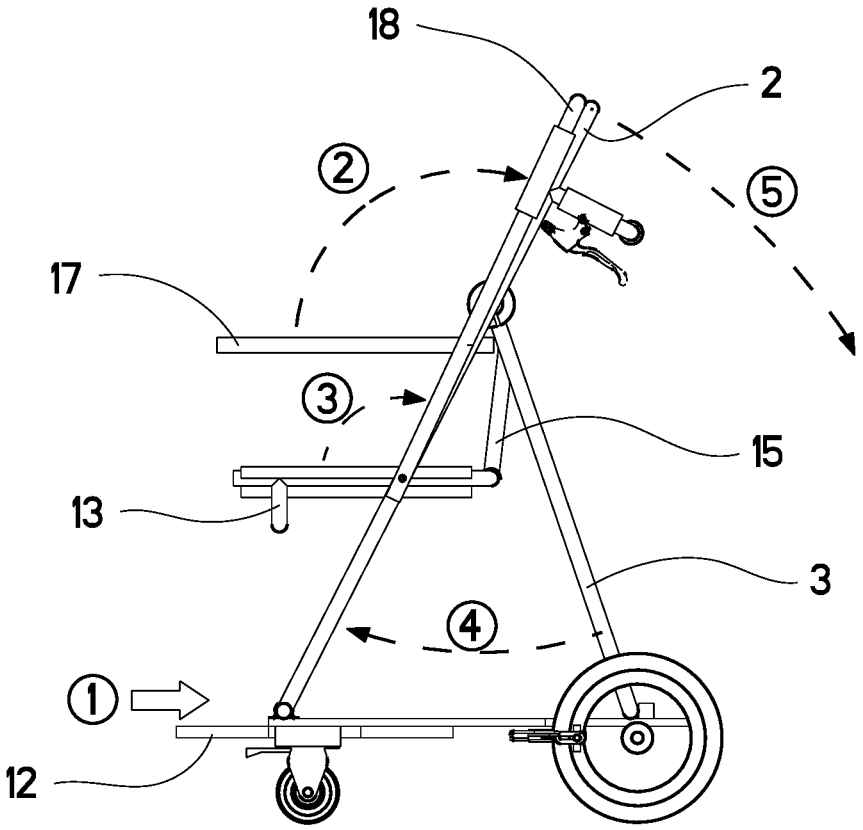
FIG. 9—Diagram—Illustrating collapsing for storage/transport.

The Seat Frame 13, shown in FIGS. 3, 4 and throughout the FIGs has a "U" shape in the front which is designed to minimize discomfort of coming into contact with the passenger's legs. The Seat Frame 13 is secured to the Front Frame 2 by two Pivot Bolts 24, as shown in FIG. 3, which allow it to have free movement in order to collapse for storage of transport as shown in FIG. 9. the rear of the Seat Frame 13 is designed to push against (but not permanently connect to) a Stop Brace for Seat 15, shown in FIGS. 3, 4, 6 and 9. This connection serves to keep the Seat 14 horizontal when weight is applied to the Seat. As a rough mental illustration, the entire seat may be thought of as having properties similar to a folding "stadium seat" with the Stop Brace limiting the seat from traveling past the horizontal position when folded down but allowing the seat to be folded-up for storage.

The Arm Supports 17 shown in FIGS. 3 and 9 are also connected to the Front Frame 2 with Arm Support Bolts 25 shown in FIG. 3. The Arm Support Bolts secure the Arm Supports to the Frame 2 while allowing them to fold upward for storage like the Seat Frame 13, as shown in FIG. 9. When the Apparatus is assembled, the Arm Supports 17 are kept in a horizontal position by pushing against the Top Crossbar 4 on Rear Support Frame 3, as shown in FIGS. 2 and 3. The Arm Supports are padded for comfort by plastic foam or a similar material.

The Backrest 16 as shown in FIG. 3 and throughout the illustrations, is padded with a suitable foam or other material for the passenger's comfort.

Figure 1:
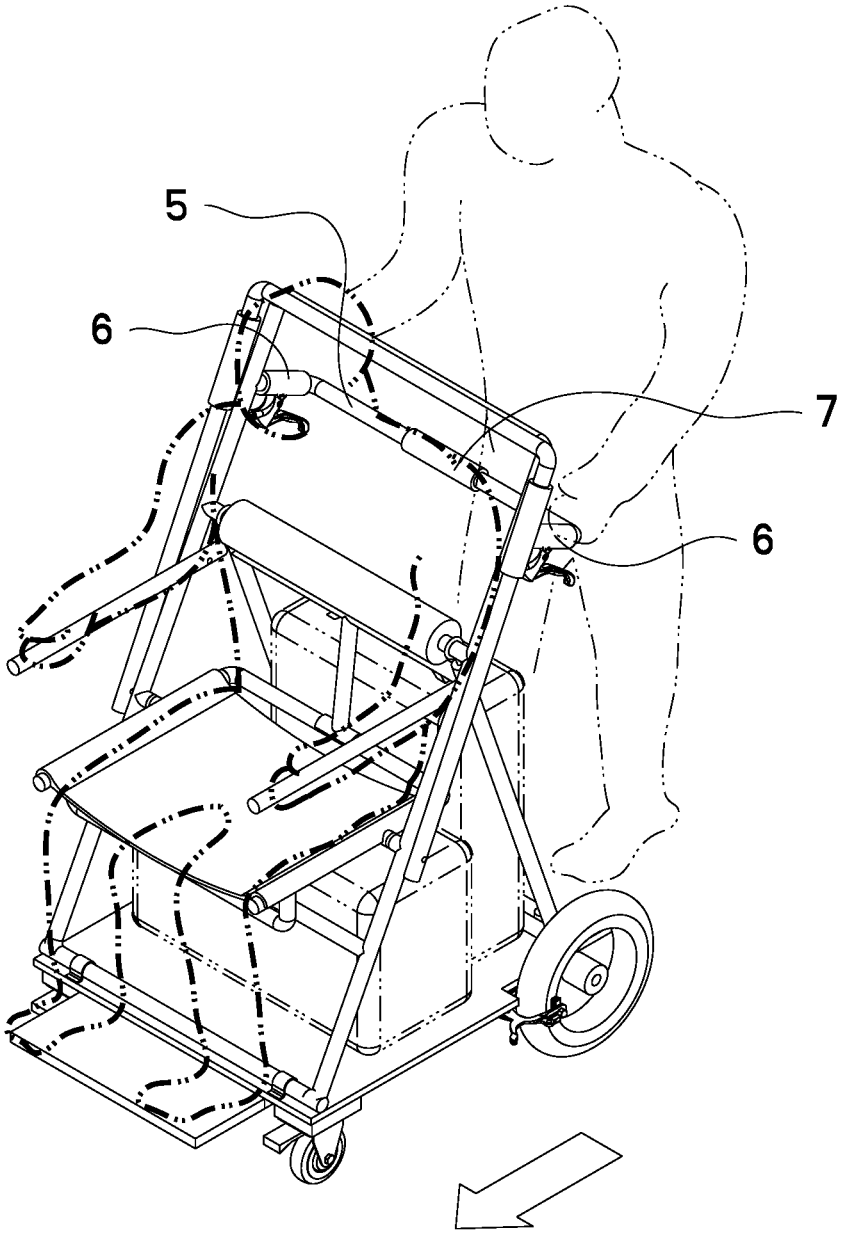
FIG. 1—Rear Operation—Bi-directional feature showing the Apparatus, with seated passenger, baggage stored on platform, and handle grips 6.

Attached to the Front Frame 2 is the Rear Handle Bar 5 shown in FIGS. 1 and 3. It permits the Apparatus to be guided from the rear using the two soft Side Hand Grips 6 shown in FIGS. 1, 3 and 4. Located near the Side Hand Grips 6 are the Brake Levers 8 shown in FIGS. 3, 4 and 8, for slowing or stopping the Apparatus. These levers may be secured in a "locked" position with elastic straps or other means to restrict their opening. In addition, the Rear Handle bar 5 with grip 7 shown in FIGS. 1, 3 and 4, functions so that the Apparatus may be pulled from the rear using the Large Wheels 10 to roll over obstacles such as a door entranceway.

Figure 5:
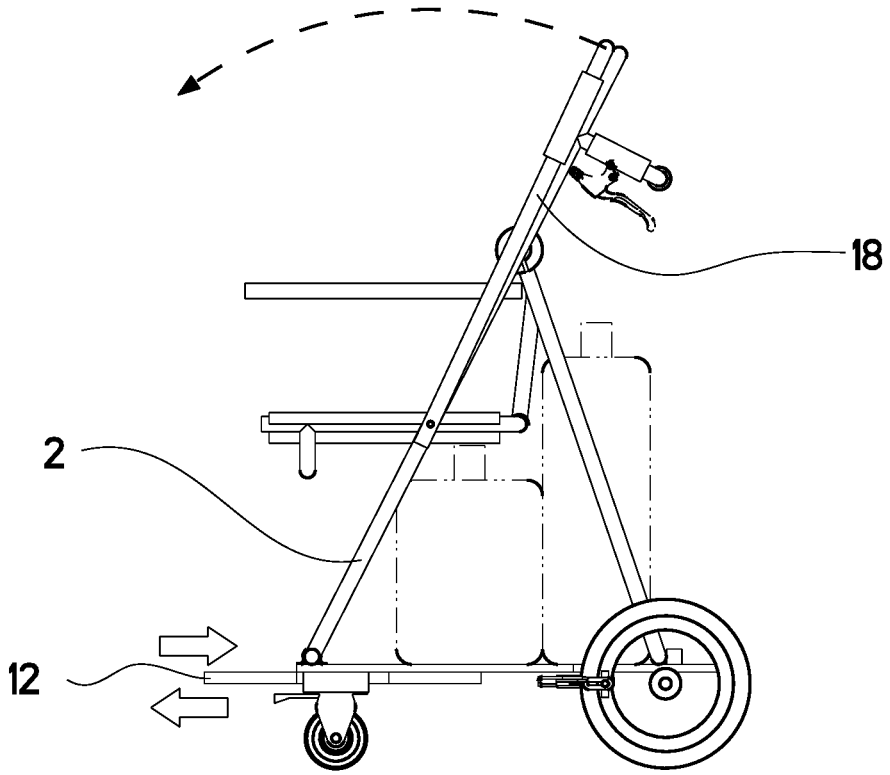
FIG. 5—Diagram of side view—Showing Front Frame 2 with attached Front Handle Bar 18. The Foot Rest 12 is shown extended.
Figure 6:
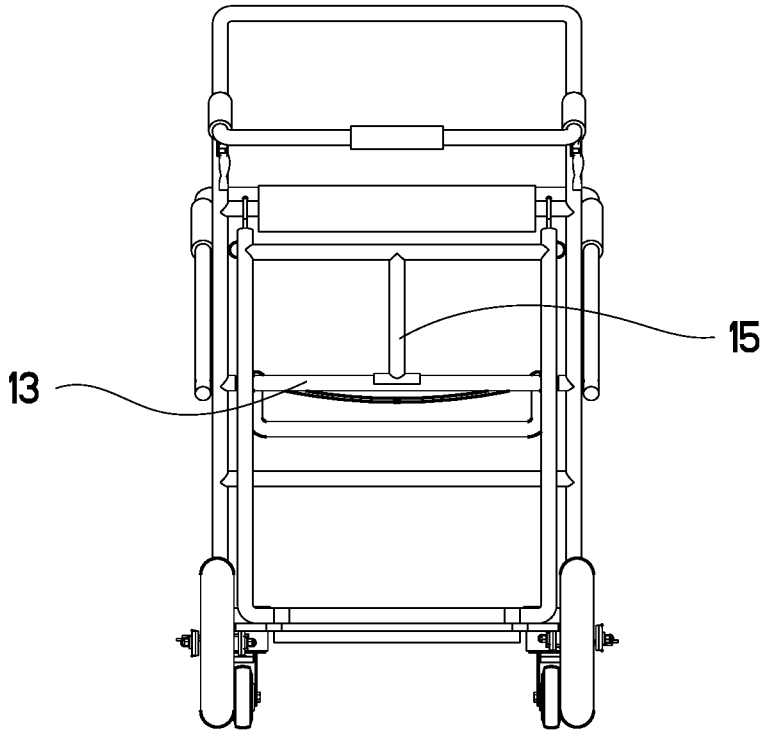
FIG. 6—Diagram—rear view—Showing the Seat Frame 13 and the Stop Brace for Seat 15 in the extended position.
Figure 7:
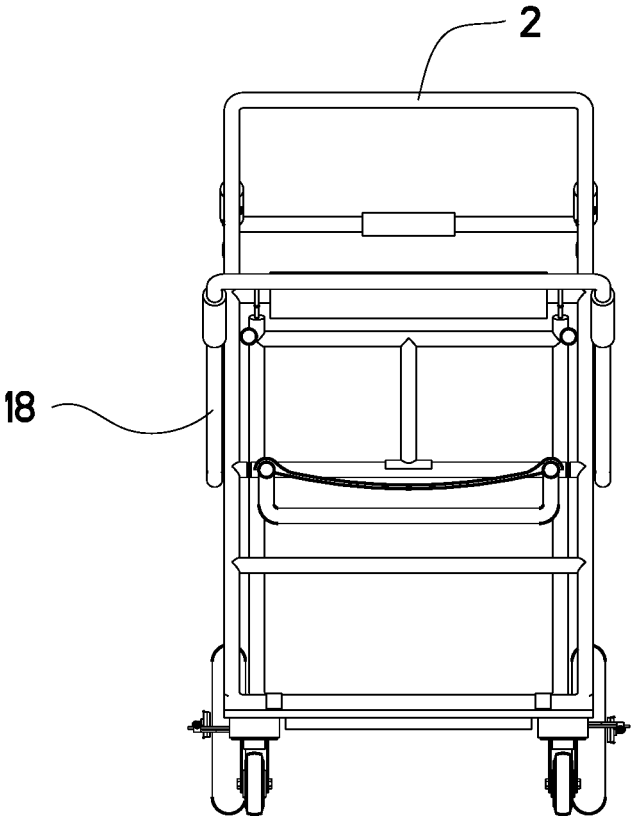
FIG. 7—Diagram—front view—Showing the Front Frame 2 and the Front Handle Bar 18 in the extended position.

Also attached to the Front Frame 2 is the Front Handle Bar 18. As shown in FIGS. 3, 5 and 8, it unlatches and swings down so that a passenger/baggage may be pushed from the front, allowing for the Apparatus to be pushed over uneven terrain and allowing for better passenger safety and verbal communication between Caregiver and passenger.

Rear Support Frame

The Rear Support Frame 3 as shown in FIGS. 3 and 9 completes a triangle when assembled with the Front Frame 2 and the Platform 1, and supports the weight from the Front Frame 2 and a passenger on the Seat 14. The Rear Support Frame 3 is kept in place by two Bottom Stops 21, as shown in FIGS. 2,3 and 8, for the Rear Support Frame Crossbar 20 shown in FIG. 3. The Bottom Stops 21 are located on the platform. The top of the Rear Support Frame 3 is attached to the Front Frame 2 by two Support Rings 26, as shown in FIGS. 3 and 4, placed on either side of the Backrest 16. The Support Rings 26 are not rigidly attached, to enable the Rear Support Frame 3 to be collapsed by folding it forward for storage or transport as shown in FIG. 9.

Although the description above contains many specificities, these should not be construed as limiting the scope of the embodiments but as merely providing illustrations of some of the presently preferred embodiments. Thus the scope of the embodiments should be determined by the appended claims and their legal equivalents, rather than the examples given.

The invention claimed is:

1. A collapsible bi-directional transport chair with baggage capability comprising:

a. a rigid oblong platform having;

(i) two or more pivoting caster wheels affixed on one end of said platform, and at the opposite end of said platform one or more large wheels capable of bi-directional operation and fitted with a braking device;

(ii) a movable foot rest contiguous with said platform positioned at the end of said platform with said pivoting caster wheels;

(iii) a predetermined area on the platform for the placement of optional items external to said collapsible transport chair, including baggage;

b. a front frame which is attached to said platform at the end of said platform with said caster wheels, through one or more mounting brackets secured to said platform permitting said front frame to be erected for use and collapsed to said platform for storage, wherein is included;

(i) a seat including a seat frame, a seat, a backrest and a pair of arm supports, said seat capable of being folded parallel to the front frame and said platform for storage or deployed in a horizontal position for use when locked into a stop brace attached to a rear support frame, and wherein said arm supports pivot and lock into a predetermined horizontal position for use or a position parallel to said rear support frame and said platform for transport/storage;

(ii) a rear handle bar for operation in the direction of travel with the user behind the passenger, and having one or more braking actuator control levers, connected to said braking device;

(iii) a front handle bar which pivots to allow said collapsible transport chair to be operated in direction of travel with the caregiver facing passenger;

c. wherein the rear support frame is affixed to said front frame through a hinge and secured from movement by one or more bottom stops affixed to the opposite end of said platform from said caster wheels, in such a manner as to allow support for said front frame and with the ability to bypass the bottom stops and collapse to said platform for transport/storage;

d. a stop brace for seat, attached to said rear support frame in such as manner that it is capable of connecting to said foldable seat and affixing the seat in a horizontal position for use, and detaching from said seat for transport/storage.

2. The collapsible bi-directional transport chair of claim 1, wherein said large wheels are capable of operation over non-smooth surfaces, including irregular sidewalks, grooved concrete, gravel or a door entranceway.

3. The collapsible bi-directional transport chair of claim 1, wherein said collapsible transport chair is composed of steel, aluminum, molded plastic, carbon fiber, or wood.

4. The collapsible bi-directional transport chair of claim 1, wherein said braking device employs said braking actuator control levers which are lockable in order to secure the bi-directional wheels from motion.

5. The collapsible bi-directional transport chair of claim 1, wherein said foldable seat is composed of one or more materials including cloth, plastic, or foam to increase the comfort of the passenger.

6. The collapsible bi-directional transport chair of claim 1, wherein said collapsible arm supports and said backrest are padded with a suitable foam or other material thereby increasing the comfort of the passenger.

7. The collapsible bi-directional transport chair of claim 1, wherein said front frame with said foldable seat and said rear support frame collapse onto said platform thereby enabling ease of transport/storage of said collapsible bi-directional transport chair.

8. The collapsible bi-directional transport chair of claim 1, wherein the pivoting caster wheels may be locked from rotation.

* * * * *